US007246982B2

(12) United States Patent
Desjarlais et al.

(10) Patent No.: US 7,246,982 B2
(45) Date of Patent: Jul. 24, 2007

(54) BOOKBINDING COIL INSERTION MACHINE

(75) Inventors: Matthew D. Desjarlais, Winnipeg (CA); Walter D. Klassen, Winnipeg (CA)

(73) Assignee: Gateway Bookbinding Systems Ltd., Winnipeg, Manitoba (CA)

( * ) Notice: Subject to any disclaimer, the term of this patent is extended or adjusted under 35 U.S.C. 154(b) by 437 days.

(21) Appl. No.: 10/449,713

(22) Filed: Jun. 2, 2003

(65) Prior Publication Data

US 2004/0240969 A1 Dec. 2, 2004

(51) Int. Cl.
*B42B 9/00* (2006.01)

(52) U.S. Cl. ..... 412/40; 412/11; 412/14; 412/38; 140/92.94

(58) Field of Classification Search ..... 412/9, 412/33, 38, 40, 6; 140/92.9, 92.93, 92.94
See application file for complete search history.

(56) References Cited

U.S. PATENT DOCUMENTS 3,122,761 A * 3/1964 Bonvier ..... 412/40
3,967,336 A * 7/1976 Cutter ..... 412/13
4,378,822 A * 4/1983 Morris ..... 140/92.3
4,872,796 A * 10/1989 Hsieh et al. ..... 412/16
5,183,361 A * 2/1993 Ho ..... 412/16
5,211,522 A * 5/1993 Ho ..... 412/16
5,419,668 A * 5/1995 Ballist ..... 412/40
5,615,986 A * 4/1997 Cox ..... 412/40
5,683,218 A * 11/1997 Mori ..... 412/40
5,890,862 A * 4/1999 Spiel et al. ..... 412/40
5,934,340 A * 8/1999 Anthony et al. ..... 140/92.94
6,000,897 A 12/1999 DesJarlais
6,036,423 A * 3/2000 Westra et al. ..... 412/38
6,056,495 A * 5/2000 Doyle et al. ..... 412/39
6,062,792 A * 5/2000 Garrity ..... 412/39
6,527,016 B2 * 3/2003 Todaro ..... 140/92.93
6,672,816 B2 * 1/2004 Mori et al. ..... 412/38
6,773,216 B2 * 8/2004 Crudo et al. ..... 412/39

* cited by examiner

*Primary Examiner*—Monica Carter
*Assistant Examiner*—Eric A. Gates
(74) *Attorney, Agent, or Firm*—Adrian D. Battison; Michael R. Williams; Ryan W. Dupuis

(57) ABSTRACT

A machine for inserting plastic pre-formed helical coils into aligned holes at an edge of respective collated books for binding the books is adjustable to accommodate different thickness books and respective different diameter and pitch of coil. The machine has a platen having an edge comb at which the edge of the book is presented and a coil drive for rotating the helical coil parallel to the edge of the platen. Two spine formers support the book such that its spine takes up a curved shape in side elevation and a clamp with an edge comb clamps the book on to the platen. Both the edge comb of the platen and of the clamp are provided as insert portions attachable to the respective element for easy replacement of the pitch. The location of the coil drive is automatically adjusted by measuring the coil diameter with a gauge. The clamp moves along an arc which automatically adjusts the clamping location for thickness of the book.

11 Claims, 5 Drawing Sheets

BOOKBINDING COIL INSERTION MACHINE

This invention relates to a machine for insertion of plastic coils into aligned holes at the edge of a collated book for binding the book, and particularly to a machine which is improved in regard to the set up procedures allowing easier and quicker change from one book size to another.

BACKGROUND OF THE INVENTION

In U.S. Pat. No. 6,000,897 of Desjarlais issued Dec. 14$^{th}$, 1999 is disclosed a machine for inserting a plastic coil into aligned holes at the edge of a book for binding of the book.

This machine which forms the basis of the present invention has achieved considerable commercial success and has operated successfully in the insertion of plastic coils automatically.

However the machine has received some criticism based upon the difficulties of adjusting the machine for initial set-up to accommodate a particular size of book. Printing in general is requiring machines to produce shorter runs of particular products so that customers can keep down levels of inventory and can customise particular books. Thus the machine is required more frequently to be set-up for different dimensions of book including particularly the thickness of the book.

It will be appreciated that the dimensions of the coil are dependant upon the thickness of the book so that a particular coil is selected to match the thickness and that coil thus has a predetermined radius of curvature thus requiring the edge of the book to be set-up at the required curvature to receive the coil as it is rotated about its axis. However coils are manufactured using different diameter of filament so that it is not possible to adjust the machine by inputting a particular coil dimension by a numerical value.

Yet further the change in thickness of the book requires a different location for the clamping system in its clamped position in view of the required curvature of the book at the position in which it is located to receive the coil.

Yet further different coils having a different pitch length are required in some circumstances depending upon the spacing of the holes in the book which is selected by the customer.

All of these elements must therefore be set in the machine before a new batch of books can be bound using the required settings on the machine and the required coil. While settings on the existing machine could be carried out without significant difficulty, it is highly desirable to provide an improved machine in which the settings can be effected with even less difficulty.

SUMMARY OF THE INVENTION

It is one object of the invention to provide a machine of the above general type which is improved in regard to the set up procedures allowing easier and quicker change from one book size to another.

According to one aspect of the invention there is provided a machine for inserting plastic pre-formed helical coils into aligned holes at an edge of respective collated books for binding the books, the machine being adjustable to accommodate different dimensions of books and respective different dimensions of coils comprising:

a platen for receiving each of the collated books in turn, the platen having an edge at which the edge of the book is presented;

a coil drive and support assembly for supporting and rotating each of the helical coils in turn at the edge of the platen about an axis of the coil parallel to the edge of the platen;

a comb guide at the edge of the platen such that rotation of the helical coil causes movement of helical turns of the helical coil along the platen into engagement with the edge of the book and into the aligned holes;

an end stop for halting movement of the coil when inserted such that ends of the coil are exposed at respective ends of the edge of the book;

the coil drive and support assembly and the platen being arranged for adjustment movement of a movable one relative to the other to accommodate different diameters of coils so as to locate each of the coils of different diameters at a required position relative to the comb guide for the respective coil to pass through the aligned holes in the respective collated book;

a gauge member for receiving a portion of a representative one of a selected series of coils and for detecting an outer diameter of the representative coil;

and a linkage operable in response to detection of the outer diameter of the representative coil for locating said adjustment movement such that each of the selected coils, when positioned at the coil drive and support assembly, is located at the required position for the selected coil and the respective collated book to pass through the aligned holes of the collated book.

Preferably the gauge member includes a fixed stop and a component attached to the movable one of the coil drive and support assembly and the platen, and the linkage is connected to the component and arranged to locate the movable one at the required position.

Preferably the platen is fixed and at least part of the coil drive and support assembly is mounted for pivotal movement relative to the fixed platen. However as shown in the above patent, the platen may be movable instead.

Preferably the coil drive and support assembly comprises a coil engagement roller for engaging the coil at the edge of the platen at a position thereon such that one end of the coil is arranged adjacent to one end of the edge of the book for movement into engagement with the edge of the book and a coil drive roller located at the edge of the platen and having a drive axis about which the coil drive roller rotates substantially parallel to the edge and a peripheral drive surface onto which the coil is placed.

Preferably either the coil engagement roller or the coil drive roller is fixed relative to the platen and the other of the coil drive roller and coil engagement roller is mounted for pivotal movement relative to the platen so as to increase a space between the coil engagement roller and the coil drive roller.

According to a second aspect of the invention there is provided a machine for inserting plastic pre-formed helical coils into aligned holes at an edge of respective collated books for binding the books, the machine being adjustable to accommodate different dimensions of books and respective different dimensions of coils comprising:

a platen for receiving each of the collated books in turn, the platen having an edge at which the edge of the book is presented;

a coil drive and support assembly for supporting and rotating each of the helical coils in turn at the edge of the platen about an axis of the coil parallel to the edge of the platen;

a comb guide at the edge of the platen such that rotation of the helical coil causes movement of helical turns of the helical coil along the platen into engagement with the edge of the book and into the aligned holes;

an end stop for halting movement of the coil when inserted such that ends of the coil are exposed at respective ends of the edge of the book;

a spine former apparatus arranged to shape each collated book such that its spine takes up a curved shape in side elevation to curve along a required arc to allow the curved shape of the helical coil to enter the aligned holes, the required arc causing the aligned holes at the face of the book outermost from the platen to be offset from the comb guide in an offset direction laterally of the platen;

the spine former apparatus being arranged such that books of different thickness have the aligned holes at the face of the book outermost from the platen offset from the comb guide in said offset direction laterally of the platen by different distances;

and a clamp member opposed to the platen for clamping the book between the clamp member and the platen, the clamp member being movable relative to the platen in a direction generally towards and away from the platen between a first clamp position for clamping the book onto the platen and a release position spaced from the platen by a distance sufficient to release the book for removal of the book and the inserted coil from the platen;

the clamp member being moved in said direction generally towards and away from the platen along line which is different from a line at right angles to the platen;

wherein the line is shaped such that, for each different thickness of book, when at the clamp position, the clamp member is offset in said offset direction laterally from the comb guide by a distance to properly locate the clamp member at the aligned holes at the face of the book outermost from the platen, without the necessity for adjustment of the clamp member in said offset direction to accommodate said different thicknesses of books.

Preferably the clamp member comprises a bar having an edge substantially aligned with the edge of the platen, the edge of the bar having a guide comb thereon for guiding movement of the coil.

Preferably the line is curved.

According to a third aspect of the invention there is provided a machine for inserting plastic pre-formed helical coils into aligned holes at an edge of respective collated books for binding the books, the machine being adjustable to accommodate different books and respective different dimensions of coils comprising:

a platen for receiving each of the collated books in turn, the platen having an edge at which the edge of the book is presented;

a coil drive and support assembly for supporting and rotating each of the helical coils in turn at the edge of the platen about an axis of the coil parallel to the edge of the platen;

a comb guide at the edge of the platen such that rotation of the helical coil causes movement of helical turns of the helical coil along the platen into engagement with the edge of the book and into the aligned holes;

an end stop for halting movement of the coil when inserted such that ends of the coil are exposed at respective ends of the edge of the book;

a spine former apparatus arranged to shape each collated book such that its spine takes up a curved shape in side elevation to curve along a required arc to allow the curved shape of the helical coil to enter the aligned holes;

and a clamp member opposed to the platen for clamping the book between the clamp member and the platen, the clamp member being movable relative to the platen in a direction generally towards and away from the platen between a first clamp position for clamping the book onto the platen and a release position spaced from the platen by a distance sufficient to release the book for removal of the book and the inserted coil from the platen;

the clamp member comprises a bar having an edge substantially aligned with the edge of the platen, the edge of the bar having a guide comb thereon for guiding movement of the coil;

wherein the platen comprises a main body and an insert portion which can be readily separated from and attached to the main body of the platen, the comb guide of the platen being formed as part of the insert portion of the platen such that the insert portion with the comb guide thereon can be readily removed and replaced by a different insert portion having a comb guide of different dimensions without removing the platen;

and wherein the clamp member comprises a main body and an insert portion which can be readily separated from and attached to the main body of the clamp member, the comb guide of the clamp member being formed as part of the insert portion such that the insert portion with the comb guide thereon can be readily removed and replaced by a different insert portion having a comb guide of different dimensions without removing the clamp member.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 3:
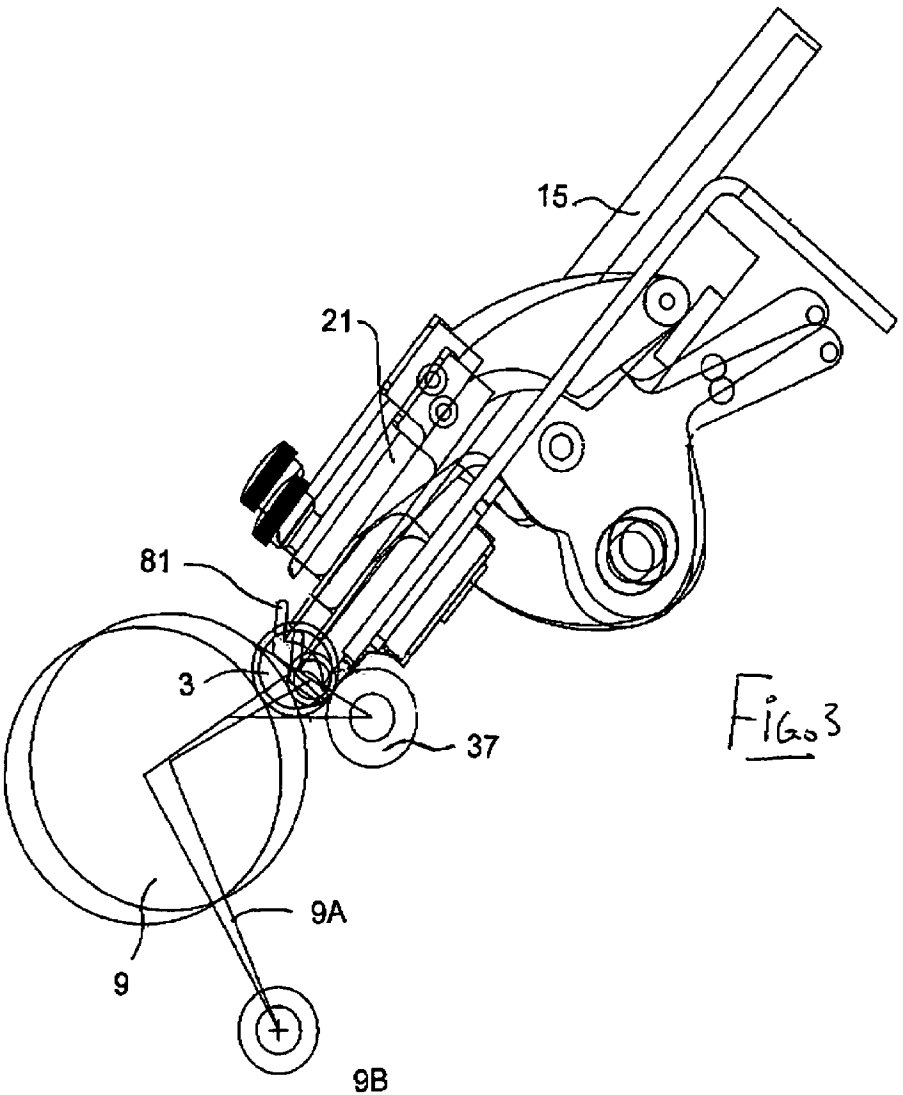
FIG. 3 is a similar cross section to that of FIG. 2 on an enlarged scale showing the geometry of movement of the coil drive roller and the book clamp.

A machine 1, as shown in the figures herein, is arranged for inserting plastic pre-formed helical coils 3 into aligned holes at an edge of a collated book as best shown in FIG. 3. A rubber roller 9 is an elongated horizontal tube that is situated so that the rubber roller 9 rotates and moves the coil 3 in a forward direction to be inserted into the aligned holes of the book. The rubber roller 9 has a drive roller shaft 11. The drive roller shaft 11 extends horizontally from the rubber roller 9 to vertical side support walls 13A and 13B.

The book is placed on a platen 15 which is located above and rearwardly of the roller 9 and extends at an inclined upwardly and rearwardly from the roller 9. At the bottom edge of the platen 15 is a comb portion 17 associated with the roller. The comb portion 17 has a plurality of teeth which are situated so that the comb portion 17 guides the coil 3 along the roller 9 toward the aligned holes of the book. The main platen comb 19 is located on the bottom edge of the platen 15 and is adjacent to the comb portion 17. The platen comb 19 has a plurality of teeth which are situated to guide the coil 3 into the aligned holes of the book which are located at the comb.

A book clamp 21 is mounted on the platen 15 and has a front end which is positioned horizontally parallel with the platen 15 and has a front edge 23. The front edge 23 of the clamp 21 extends downwardly such that the front edge 23 corresponds approximately with the bottom edge of the platen 15. The front edge 23 of the clamp 21 has a clamp comb 25. The clamp comb 25 is located at the furthermost bottom end of the front edge 23 of clamp 21. The clamp comb 25 and the platen comb 19 each consist of a plurality of teeth spaced at coil pitch with a plurality of wider spaced teeth defining gaps 27. The book clamp 21 is mounted on a support assembly described in more detail hereinafter.

A second metal drive roller 37 extends horizontally from the first vertical support wall 13A to a second vertical support wall 13B and rotates substantially parallel to the first drive roller 11 behind the first drive roller 11.

A side lay (not shown) is located on the platen 15 and is a square block which runs parallel with the platen 15 has a four sides designed with different angles relative to the surface of the platen 15 to place the side edge of the book at the required angle to receive the coil depending upon the pitch of the coil and its diameter.

Figure 1:
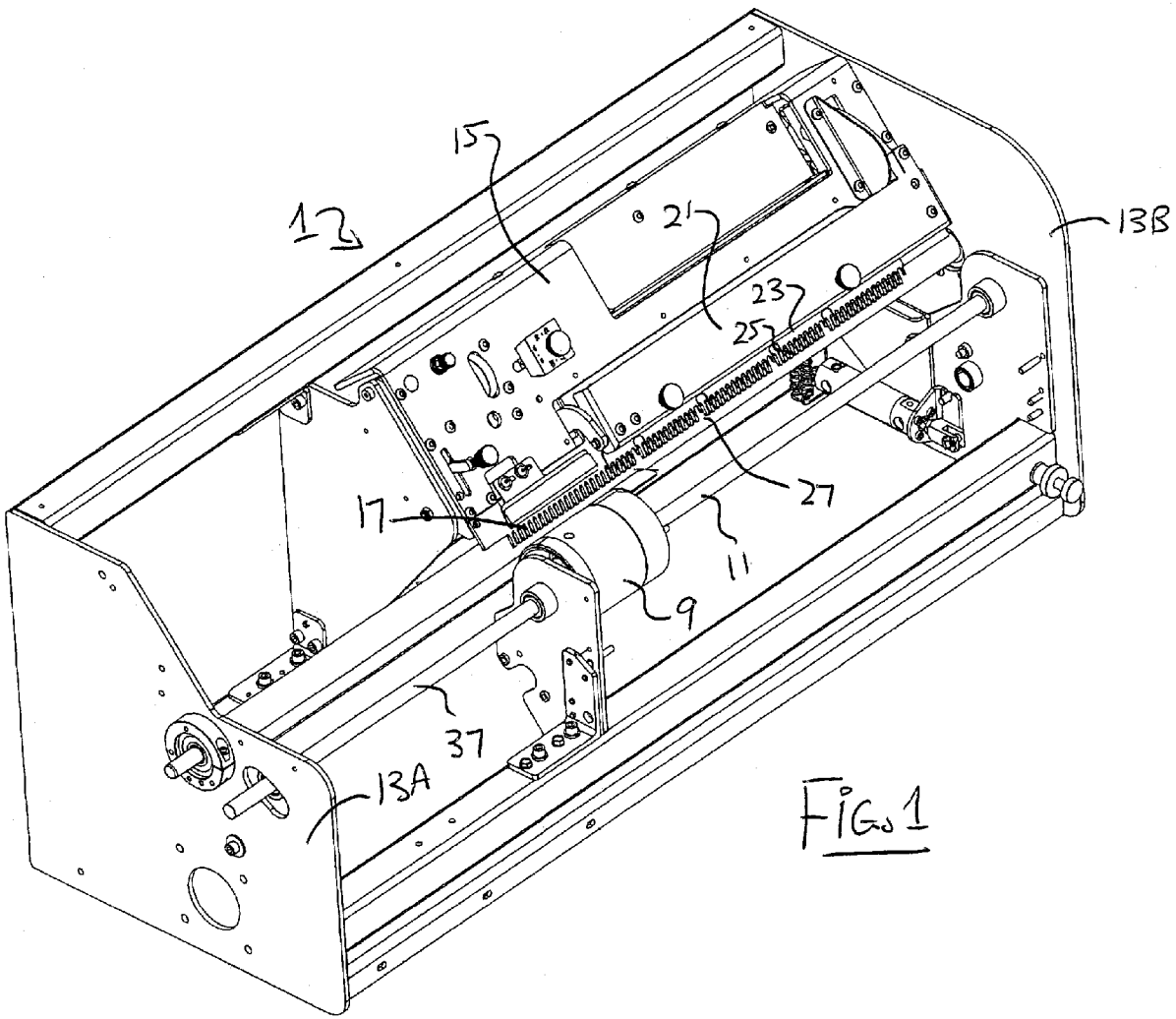
FIG. 1 is a drawing taken from the above U.S. Pat. No. 6,000,897 which shows the general operation of the machine in which the present invention is concerned.

Spine formers 81 (not shown in FIG. 1) are located at the bottom edge of the platen 15 within the comb gaps 27 curving around the platen comb 19. The spine formers have a mount portion which is attached to the platen 15 and extend forwardly therefrom. The spine formers 81 have an arched end 87 in which the edge of the book with the aligned holes is placed.

In operation, the plastic coil 3 is placed onto the rollers 9 and 37 at the comb portion 17 of the platen 15 such that the coil rests on the rubber roller 9 and the guide roller 37 and is guided by the comb portion 17. The book is placed on the platen 15 such that it rests on the arched end 87 of the spine formers 81. The book clamp 21 is arranged in a position wherein the clamp comb is angled so that the book is guided onto the spine formers by the book clamp and the book is pressed against the side lay 75 so that the book takes the appropriate shape. Then the operator presses the start pedal and the book clamp 21 presses on the book to ensure that the book remains stable and the coil is supported along the roller.

The motor engages the first roller drive belt turning the first roller drive 11 and its roller 9 and the second roller drive belt turning the second roller drive 37 and together they cause the coil to advance towards the book. As the coil is inserted through the aligned holes of the book the platen comb 19 and the clamp comb 27 continue to guide the coil.

When the coil is completed being inserted through the books aligned holes, a coil support drops away from the coil so that cutting and bending heads can be raised and proceed to cut the ends of the coil and bend them simultaneously so that the coil remains in place. These elements are not shown for convenience of illustration but are well known to one skilled in the art.

When the book is bound the cutting and bending heads move back to the start position, the book clamp releases and the book can now be removed.

In setting up the machine 1 the spine formers 81 are used to create a curvature to the binding edge of the book. The spine former must correspond to the diameter of coil 3 that is being used.

The book clamp comb 25 should be in line with the bottom edge of the book without obstructing any of the punched holes. The book clamp comb 25 must be horizontally adjusted so that the spine formers 81 fit into the wide teeth gap 27 of the book clamp comb 25. A coil stop (not shown) is placed adjacent to the teeth of the platen comb 19 to stop the coil 3 once it has been inserted into the book. The operator places a coil stop on the platen comb teeth in such a position so that, when a coil is inserted into the book, the majority of the excess is to the right of the now bound book.

Further details of the above machine are described in the above US patent, the disclosure of which is incorporated herein by reference so that any further details required can be obtained from review of the above patent.

Figure 2:
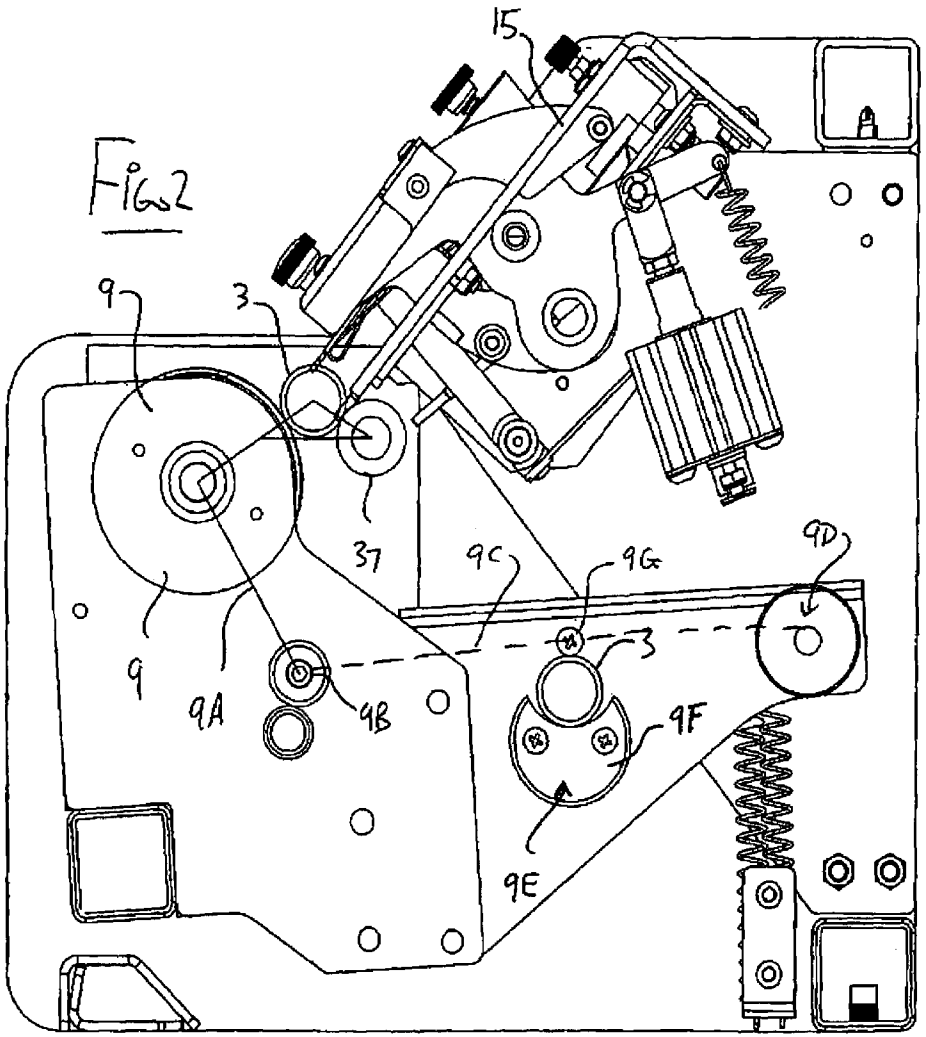
FIG. 2 is a vertical cross sectional view through the machine according to the present invention showing the mounting of the carriage which carries the drive roller and showing the mounting of the clamp bar.

The machine of the present invention is shown in more detail in FIG. 2 and is modified in respect of the above patent by a number of features of importance related to the present invention.

Firstly the platen 15 in the present machine is fixed and does not change in inclination but instead the position of the drive roller 9 is moved to accommodate different sizes of coil. The drive roller 9 co-operates with the support roller 37 to define a cusp therebetween into which the coil 3 sits at the comb 17 of the platen and the corresponding comb 27 of the clamp 21. The positioning of the coil is therefore obtained by moving the drive roller 9 inwardly and outwardly relative to the roller 37 so as to decrease and increase the spacing therebetween thus allowing the receipt in the cusp of different sizes of the coil.

Regardless of the diameter of the coil, the inside edge of the coil sits against the roller 37 in contact therewith. The location of the turn of the coil as it leaves the roller 37 and passes through the comb is determined by the position of the roller 9.

The roller 9 is carried on a carriage 9A which is mounted for pivotal movement about a pivot shaft 9B. The carriage 9A includes a drive mechanism (not shown) for driving the roller 11 of the drive roller 9. The carriage 9A carries a lever 9C which extends from the pivot shaft 9B along the end plate 13B of the machine to a clamp 9D which can be manually operated to clamp the lever 9C to the end wall 13B. Thus the position of the roller 9 relative to the roller 37 is adjusted by pivoting the carriage 9A relative to the pivot shaft 9B and locating the carriage by the clamp 9D. The geometry of the construction is arranged such that the pivotal movement properly locates the coils of the required dimensions at the roller 37 and the comb 17.

The required position of the carriage 9A is obtained by a gauge member 9E which is arranged to receive a sample one of the coils to be used. The gauge member 9E comprises a gauge block 9F having a concave upper surface for locating the outer cylindrical surface of the coil at the centre of the gauge block 9F. The lever 9C carries a gauge pin 9G which is mounted so that it is positioned above the coil 3 located in the gauge member. Thus the operator releases the clamp 9D lifting the lever 9C and inserts a sample of the coil to be used into the gauge member on top of the block 9F.

The operator then lowers the lever 9C gently downwardly onto the top of the coil thus using the gauge pin 9G to measure the outside diameter of the coil without applying sufficient force to in any way compress the coil. When the gauge pin 9G is moved into position on top of the coil, the clamp can be moved to the clamped position thus locating the lever 9C at the angle determined by the diameter of the coil on the gauge member.

The geometry and location of the gauge member is such that the measurement of the outside diameter of the sample coil at the gauge member properly locates the roller 9 relative to the roller 37 so that the sample coil, and other identical coils, when inserted into the cusp between the roller 37 and the roller 9 are properly located relative to the edge of the platen and the comb thereon.

Many such coils are formed from filaments of different thickness. However the coils are formed by wrapping such filament around a mandrel of a predetermined outside diameter. Thus such coils are formed by measuring and locating the inside surface of the filament to the required diameter. Thus the exterior diameter of coils manufactured by different machines will vary depending upon the thickness of the filament. The required dimension for the insertion machine is that of the outside diameter of the coil since that outside diameter co-operates with the drive rollers and with the comb in locating the coil and inserting it through the aligned holes of the collated book.

Figure 5:
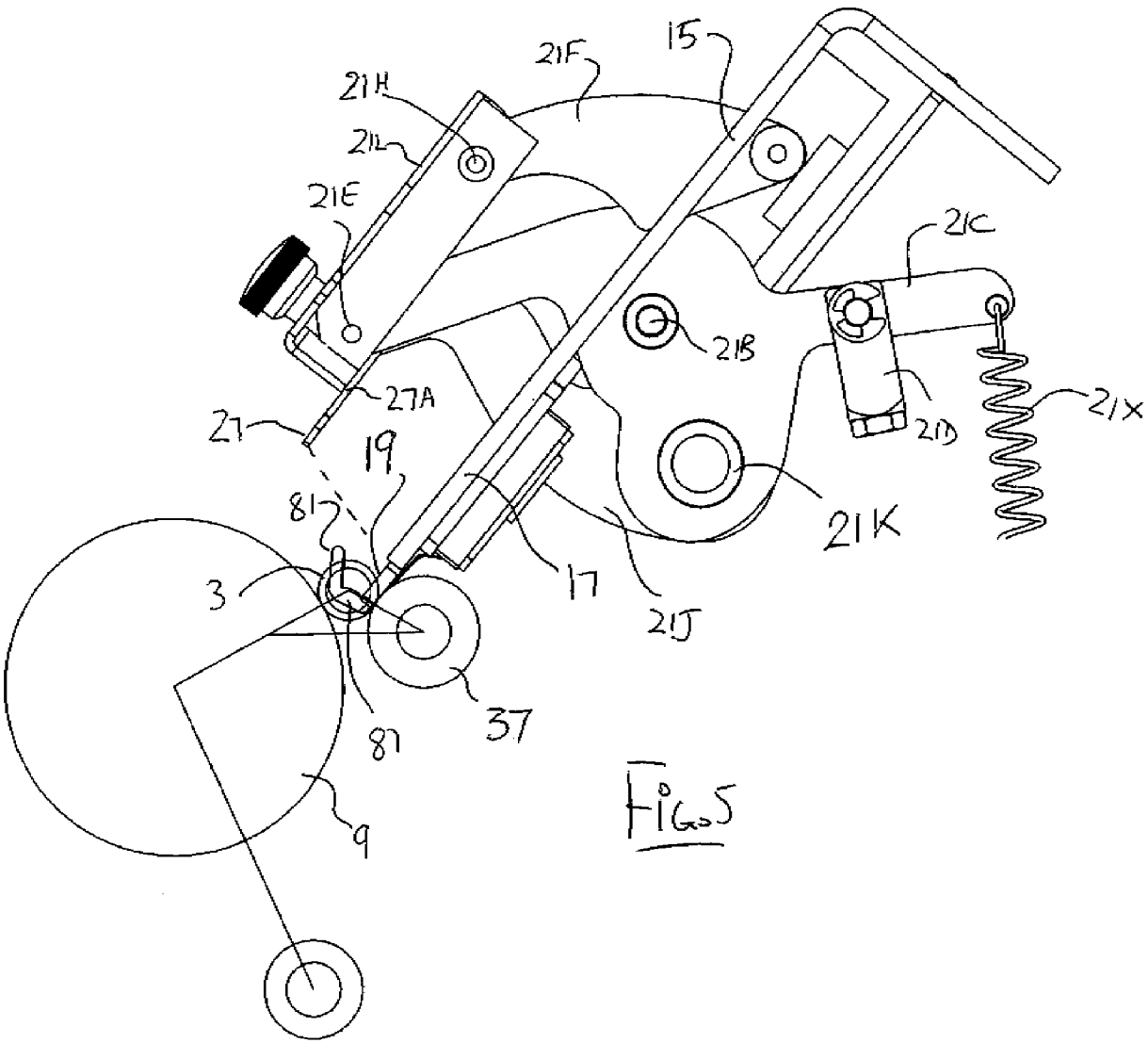
FIG. 5 is a cross sectional view of similar to that of FIG. 2 showing the drive arrangement for the book clamp.

Turning now to the mounting and operation of the clamping plate, as best shown in FIG. 5, the platen 15 carries the book which is dropped at its lower end onto the spine former 81 and the curved support 87 of the spine former 81. This shapes the spine at the aligned hole into the required curvature by which the rotation of the coil drives the filament of the coil through the aligned holes. It will be appreciated that the curvature of the spine former must match the curvature of the coil and thus the curvature of the spine former is different for different thicknesses of book since the curvature of the coil associated with that different thickness of book is changed.

As the curvature of the spine former changes, it is necessary for the spine former to lift the outer edge of the book spaced away from the platen 15 slightly relative to the inner edge of the book at the platen. Thus as shown in FIG. 5 the comb 19 of the platen is located at a fixed position relative to the different shapes of spine former. However the outer edge of the support portion 87 of the spine former is lifted relative to the comb 19 so as to provide the required curvature of the book relative to the fixed position of the roller 37.

In order for the comb 25 to be properly located at the holes at the book on its outer face, bearing in mind the changing location of the outer face of the book relative to the inner face, it is necessary for the comb 25 to be moved relative to the comb 19 in a direction transverse to the comb edge for different thicknesses of book. Thus for very thin books, the outside surface of the book is substantially at the same location as the inside surface relative to the comb 19. However for thick books, the outside surface is raised or moved laterally from the edge of the comb 19 thus requiring the comb 25 to be moved laterally or upwardly as shown by a similar distance if it is to avoid interfering with the holes in the book while at the same time being located as close as possible to the holes in the book.

In order to obtain this location of the clamp comb 25 for different thicknesses of book without the necessity for lateral adjustment of the clamping member, the clamping member is mounted on a carriage 21A which acts to move the clamping member 21 and its comb 25 in an arc A rather than a straight line L at right angles to the platen 15. Thus the clamping member pivots about a pivot shaft 21B and is driven by a lever 21C driven by a cylinder 21D and retracted by a spring 21X which moves the clamp member along the arc rotating around the axis of the shaft 21B. The actuating member 21A is connected to the clamp member at a pivot 21E. The actuating member 21A includes a lever 21F pivotal at a pin 21G which also connects to the clamp member at a pivot 21H. Thus the clamp member is maintained substantially parallel to the platen 15 and the outside surface of the book but moves along the arc so that the tips of the comb 25 move along the required path which is the same as the locus of the points of the required locations for the comb for the different thicknesses of books. A drive tube 21K extends to an opposite end of the clamp member 21 and a link 21J extends from the drive tube 21K to the clamp member so as to act as a torque transfer system to drive both ends of the clamp member.

In this way, instead of moving the clamp member at right angles to the platen and then laterally adjusting the position of the fingers of the comb in the clamp position, the present arrangement moves the clamp member along the same arc as the locus of required positions and thus avoids the necessity for individual adjustment of the clamp member in dependence upon the thickness of the book.

Figure 4:
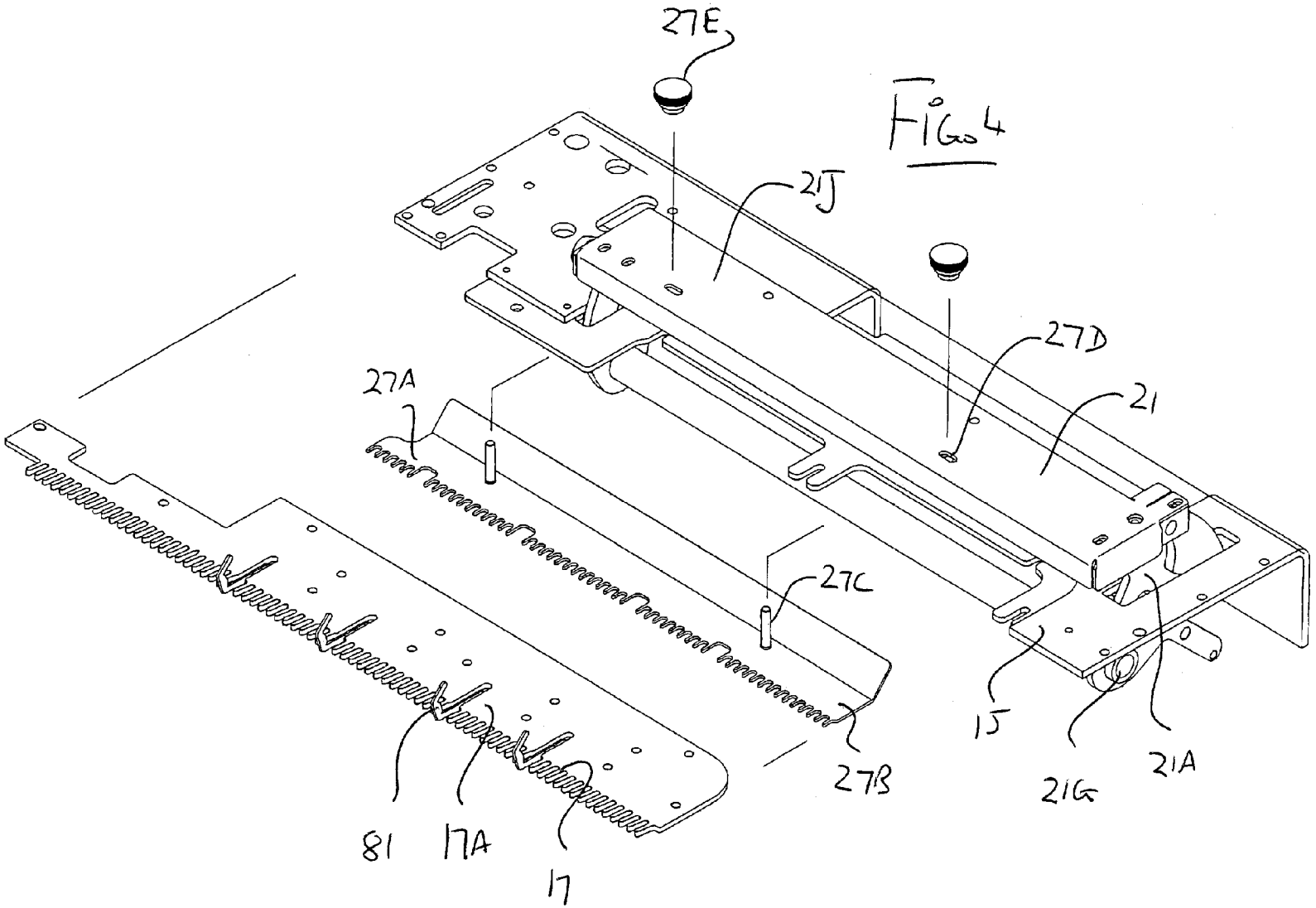
FIG. 4 is an exploded view showing the platen and clamp assembly including the separate insert pieces providing the coil comb.

Turning now to FIG. 4 the construction of the clamp member 21 including the actuator 21A is shown together with the platen 15 in isometric view. It will be noted that the clamp member 21 comprises a plate 21L which extends partly along the platen with the actuators at each end of the plate 21L extending through holes in the platen to the actuating elements underneath the platen. The plate 21L provides a support for a separate comb 27A which is formed on a rigid insert member 27B with mounting pins 27C for engaging through holes 27D in the plate 21J. Thus with the clamp plate 21L in a raised position, the comb can be inserted underneath the plate 21L with the posts 27C projecting through the bar and fastened thereto by screws 27E. Thus the whole of the comb 27 is provided as a separate insert member which can be readily attached to and removed from the clamping bar allowing combs of different pitch to be held as separate replaceable inserts and selected for attachment to the clamping bar as required depending upon the pitch of the coil to be inserted.

Similarly the comb 17 of the platen 15 is formed as a separate insert member 17A with the comb formed along the front edge of the insert member 17A. The insert member 17A carries the spine formers 81 which are fastened thereto at the required slots in the comb. As explained previously, the spine formers are selected in accordance with the required thickness of the book and the comb 17 can be selected from a set of the insert members 17A which are provided for different pitch of coil to match the pitch of the comb 27. The insert member 17A can be bolted to the top surface of the platen 15 by screw fasteners passing through aligned holes thus locating the comb at the required position at the edge of the platen.

In this way the insert members 27A and 17A can be stored as required for the different pitch of coils which can be selected by the customer as required for a particular book construction. The machine operator can then select the insert members from storage at attach them to the clamp member and to the platen readily and without difficulty without the necessity for removing the clamp member or removing the platen or altering the location, adjustment or operation of either of those elements.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A machine for inserting plastic pre-formed helical coils into aligned holes at an edge of respective collated books for binding the books, the machine being adjustable to accommodate different dimensions of books and respective different dimensions of coils comprising:

a platen for receiving each of the collated books in turn, the platen having an edge at which the edge of the book is presented;

a coil drive and support assembly for supporting and rotating each of the helical coils in turn at the edge of the platen about an axis of the coil parallel to the edge of the platen;

the coil drive and support assembly including a coil drive roller for contacting the coil;

a comb guide at the edge of the platen such that rotation of the helical coil causes movement of helical turns of the helical coil along the platen into engagement with the edge of the book and into the aligned holes;

the coil drive and support assembly and the platen having an adjustment mechanism for adjustment movement to accommodate different diameters of coils so as to locate each of the coils of different diameters at a required position relative to the comb guide for the respective coil to pass through the aligned holes in the respective collated book;

a linkage operable for locating said adjustment movement of the adjustment mechanism;

and a gauge member;

the gauge member having a seat for receiving a portion of a representative one of a selected series of coils such that one part of a periphery of the representative one of the coils engages the seat of the gauge member;

the gauge member including a contact member on the linkage at a position thereon separate from and spaced from the driven roller of the coil drive and support assembly;

the contact member and the seat of the gauge member being arranged such that the contact member and the seat engage said representative one of the coils on the seat for locating said adjustment movement of the adjustment mechanism.

2. The machine according to claim 1 wherein the platen is fixed and at least part of the coil drive and support assembly is mounted for pivotal movement relative to the fixed platen.

3. The machine according to claim 1 wherein the coil drive and support assembly comprises a coil engagement roller for engaging the coil at the edge of the platen at a position thereon such that one end of the coil is arranged adjacent to one end of the edge of the book for movement into engagement with the edge of the book and said coil drive roller located at the edge of the platen and having a drive axis about which the coil drive roller rotates substantially parallel to the edge and a peripheral drive surface onto which the coil is placed.

4. The machine according to claim 3 wherein the coil engagement roller is fixed relative to the platen and the coil drive roller is mounted for pivotal movement relative to the platen so as to increase a space between the coil engagement roller and the coil drive roller.

5. The machine according to claim 1 wherein there is provided a spine former apparatus arranged to shape each collated book such that its spine takes up a curved shape in side elevation to curve along a required arc to allow the curved shape of the helical coil to enter the aligned holes, the required arc causing the aligned holes at the face of the book outermost from the platen to be offset from the comb guide in an offset direction laterally of the platen, the spine former apparatus being arranged such that books of different thickness have the aligned holes at the face of the book outermost from the platen offset from the comb guide in said offset direction laterally of the platen by different distances.

6. The machine according to claim 1 wherein there is provided a clamp member opposed to the platen for clamping the book between the clamp member and the platen, the clamp member being movable relative to the platen in a direction generally towards and away from the platen between a first clamp position for clamping the book onto the platen and a release position spaced from the platen by a distance sufficient to release the book for removal of the book and the inserted coil from the platen, the clamp member being moved in said direction generally towards and away from the platen along line which is different from a line at right angles to the platen, wherein the line is shaped such that, for each different thickness of book, when at the clamp position, the clamp member is offset in said offset direction laterally from the comb guide by a distance to properly locate the clamp member at the aligned holes at the face of the book outermost from the platen, without the necessity for adjustment of the clamp member in said offset direction to accommodate said different thicknesses of books.

7. The machine according to claim 6 wherein the clamp member comprises a bar having an edge substantially aligned with the edge of the platen, the edge of the bar having a guide comb thereon for guiding movement of the coil.

8. The machine according to claim 6 wherein the line is curved.

9. The machine according to claim 1 wherein the platen comprises a main body and an insert portion which can be readily separated from and attached to the main body of the platen, the comb guide of the platen being formed as part of the insert portion of the platen such that the insert portion with the comb guide thereon can be readily removed and replaced by a different insert portion having a comb guide of different dimensions without removing the platen.

10. The machine according to claim 9 wherein there is provided a clamp member opposed to the platen for clamping the book between the clamp member and the platen, the clamp member being movable relative to the platen in a direction generally towards and away from the platen between a first clamp position for clamping the book onto the platen and a release position spaced from the platen by a distance sufficient to release the book for removal of the book and the inserted coil from the platen; the clamp member comprising a bar having an edge substantially aligned with the edge of the platen, the edge of the bar having a guide comb thereon for guiding movement of the coil; and the clamp member comprising a main body and an insert portion which can be readily separated from and attached to the main body of the clamp member, the comb guide of the clamp member being formed as part of the insert portion such that the insert portion with the comb guide thereon can be readily removed and replaced by a different insert portion having a comb guide of different dimensions without removing the clamp member.

11. A machine for inserting plastic pre-formed helical coils into aligned holes at an edge of respective collated books for binding the books, the machine being adjustable to accommodate different dimensions of books and respective different dimensions of coils comprising:

a platen for receiving each of the collated books in turn, the platen having an edge at which the edge of the book is presented;

side support walls of the machine generally at right angles to the platen and arranged at sides of the machine;

a coil drive and support assembly for supporting and rotating each of the helical coils in turn at the edge of the platen about an axis of the coil parallel to the edge of the platen;

the coil drive and support assembly including a coil drive roller for contacting the coil;

a comb guide at the edge of the platen such that rotation of the helical coil causes movement of helical turns of the helical coil along the platen into engagement with the edge of the book and into the aligned holes;

the coil drive and support assembly and the platen having an adjustment mechanism for adjustment movement, about an axis generally at right angles to said side support walls, to accommodate different diameters of coils so as to locate each of the coils of different diameters at a required position relative to the comb guide for the respective coil to pass through the aligned holes in the respective collated book;

a linkage including a lever arranged adjacent one of said side walls with the lever being pivotal about said axis and operable for locating said adjustment movement of the adjustment mechanism;

and a gauge member located at said one of said side walls;

the gauge member having a seat at said one of the side walls for receiving a portion of a representative one of a selected series of coils such that one part of a periphery of the representative one of the coils engages the seat of the gauge member;

the gauge member including a contact member connected to the lever;

the contact member and the seat being arranged such that the contact member and the seat engage said representative one of the coils on the seat for locating the lever relative to the seat and therefore said adjustment movement of the adjustment mechanism.

* * * * *